United States Patent [19]

Paul

[11] Patent Number: 4,822,173

[45] Date of Patent: Apr. 18, 1989

[54] WITHDRAWAL SYSTEM FOR VESSEL

[75] Inventor: Kermit D. Paul, Bethlehem, Pa.

[73] Assignee: Fuller Company, Bethlehem, Pa.

[21] Appl. No.: 72,836

[22] Filed: Jul. 13, 1987

[51] Int. Cl.[4] ..... B01F 13/02; B01F 15/02

[52] U.S. Cl. ..... 366/101; 251/117; 366/193; 366/341

[58] Field of Search ..... 366/101, 192, 193, 341, 366/106, 107, 3, 9, 10, 184; 239/124, 587; 222/525; 137/268, 599; 251/117, 121

[56] References Cited

U.S. PATENT DOCUMENTS 4,194,845 2/1980 Krambrock ..... 366/101

4,286,883 4/1981 Johanson ..... 366/192

4,569,596 2/1986 Romanchik ..... 366/107

4,573,800 4/1986 Lasso ..... 366/101

*Primary Examiner*—Philip R. Coe

*Attorney, Agent, or Firm*—Frank H. Thomson

[57] ABSTRACT

A high capacity withdrawal system for a pellet blender which includes a venturi shaped gas supply nozzle mounted in the gas inlet, material outlet of the vessel. The venturi nozzle allows high velocity gas to be supplied to the bottom of the vessel for circulating material through a vertical lift column in the vessel. When it is desired to discharge material from the vessel, the flow control nozzle is moved away from the discharge opening to increase its effective size to allow rapid withdrawal from material from the vessel.

6 Claims, 1 Drawing Sheet

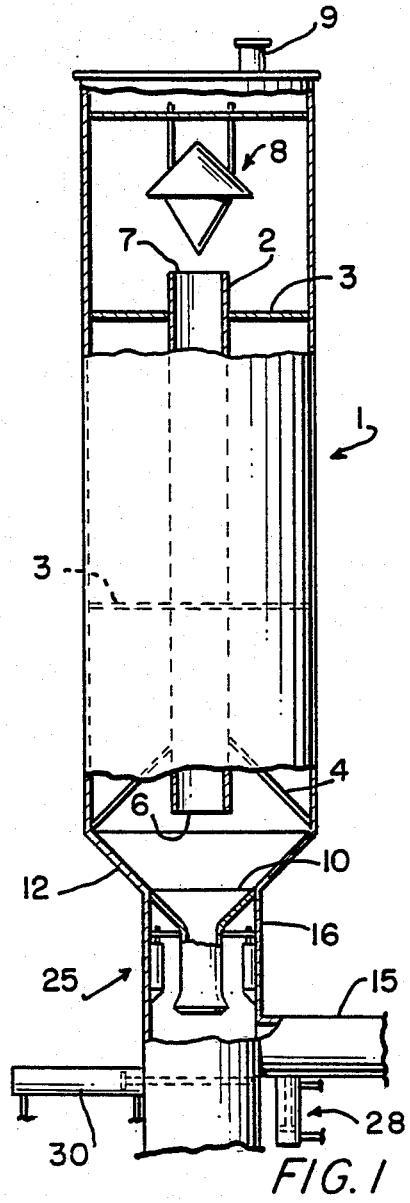
FIG. 1
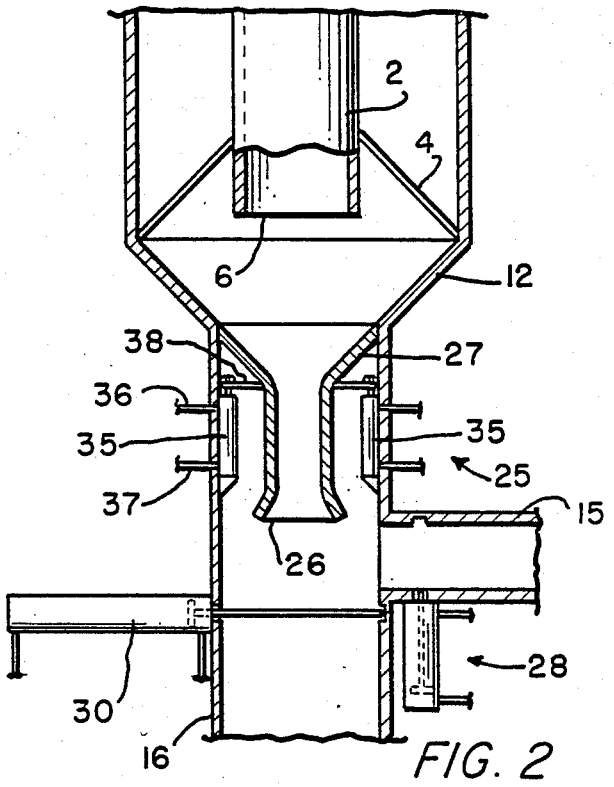
FIG. 2
FIG. 3
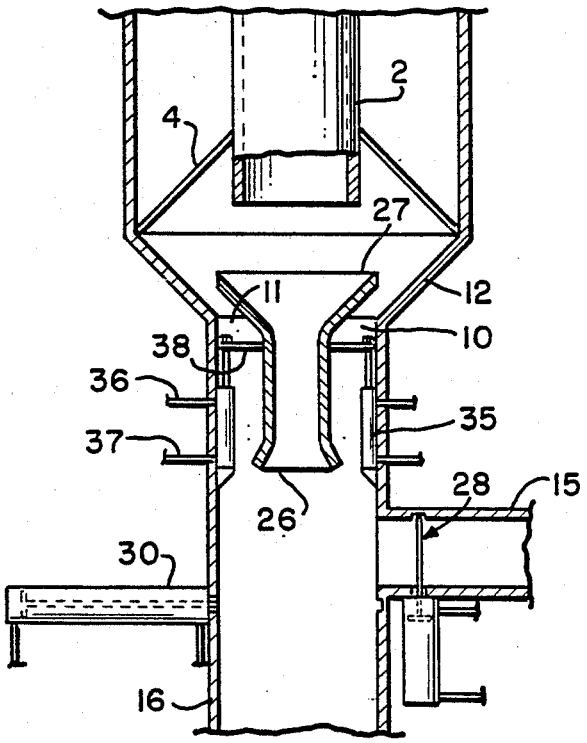

WITHDRAWAL SYSTEM FOR VESSEL

BACKGROUND OF THE INVENTION

This invention relates to a withdrawal system for a vessel containing solid particulate material and in particular, to a vessel utilized for blending particulate material such as plastic pellets.

Blenders to which the present invention relates have been generally known and include a vertically oriented vessel having a inlet for particulate material and an outlet for particulate material. The outlet for discharging the particulate material from the vessel is positioned in the conical bottom of the vessel. As a blender, the device may have a system for recirculating or mixing material within the vessel to achieve blending. This recirculation means may be the form of a centrally located vertical lift pipe inside the vessel. Gaseous fluid under pressure may be supplied to the bottom of the vessel below the lower end of the lift pipe. As the gaseous fluid under pressure is supplied to the bottom of the vessel it entrains the particulate material near the bottom of the vessel and lifts it up through the lift column where it is discharged from the outlet of the lift column in a geyser like manner onto the top of the vessel. As a result, material circulates from the top of the vessel down to the bottom of the vessel by gravity and then is lifted by the gas under pressure back up to the top.

Since it is desirable to have a high velocity gas stream at the bottom of the vessel for entraining the particulate material in the bottom thereof for lift up through the column, it would be desirable to provide a smaller opening at the bottom of the vessel. This will enable a lower volume and pressure gas to be used to circulate material through the lift column thereby decreasing energy consumption. However, when it is desired to withdraw material from the vessel, it is desired to do so at a rapid rate, and to accomplish this it would be desirable to provide a large opening at the outlet of the vessel. While separate gas inlets or nozzles could be provided, these have not proved to be entirely satisfactory.

SUMMARY

It is therefore the principal object of this invention to provide a withdrawal apparatus for a vessel for particulate material which can control both the gaseous fluid supply to the bottom of the vessel used for blending material within the vessel and controlling the withdrawal of material from the vessel.

It is a further object of this invention to provide an apparatus which defines a small area gas inlet and a large area material withdrawal in the bottom of a vessel for particulate material.

In general, the foregoing and other objects will be carried out by providing in a vessel for particulate material having a material outlet in the bottom thereof for discharging material from the vessel and means for supplying gaseous fluid under pressure to the vessel flow connected to the vessel through the material outlet, an improved material withdrawal apparatus comprising a conduit mounted on the bottom of the vessel at the material outlet; means defining a gaseous fluid inlet nozzle mounted in said conduit and operatively associated with the material outlet; and means for adjusting the position of the inlet nozzle for controlling the effective size of the material outlet.

The invention includes a piston cylinder arrangement for adjusting the position of a material and fluid flow control apparatus which includes a venturi shaped gaseous fluid inlet nozzle. The nozzle may be moved away from the outlet of the vessel to increase the size of the opening during material withdrawal by allowing material to flow both through and around the nozzle. The nozzle is moved into contact or towards the material outlet when it is desired to reduce the size of the opening in the bottom of the vessel to aerate material and recirculate material within the vessel through the vertical lift column.

BRIEF DESCRIPTION OF THE DRAWING

The invention will be described in connection with the annexed drawing wherein:

FIG. 1 is a diagramatic view in section of the apparatus according to the present invention;

FIG. 2 is a fragmentary view of the apparatus shown in FIG. 1 on an enlarged scale showing the flow control nozzle in a position where gas under pressure is supplied to the bottom of the vessel; and FIG. 3 is a view similar to FIG. 2 showing the apparatus in a position where material is to be withdrawn from the vessel.

DESCRIPTION OF THE PREFERRED EMBODIMENT

The invention will be described in connection with a pellet blender similar to that shown in U.S. Pat. No. 4,573,800 issued Mar. 4, 1986, U.S. Pat. No. 4,569,596 issued Feb. 11, 1986 and U.S. patent application Ser. No. 06/848,005 filed Apr. 3, 1986, all assigned to the assignee of the present invention.

The blender according to those applications and patents includes a vessel generally indicated in the drawings of the present application at 1. This vertically oriented vessel may include a centrally mounted lift column 2 mounted by means of brackets 3 and 4 inside the vessel 1. The vessel also includes a suitable inlet for material and an outlet 10 for material which coincides with an inlet for gaseous fluid under pressure for a purpose to be described. In the preferred form, the inlet for particulate material may also be at 10 wherein material is supplied from a source (not shown) through a suitable conveying line by means of gaseous fluid such as air under pressure into the bottom of the vessel. It is to be understood that the present invention is also applicable to those cases where material is supplied to the top of the vessel through an inlet (not shown).

Assuming that the vessel is partially filled with material, and it is desired to blend or mix material within the vessel, a gaseous fluid under pressure is supplied through conduit 15 to conduit 16 mounted on the conical bottom 12 of the vessel 1 at the outlet 10. The gas flows through the opening 10 up through the lift column 2 entraining material in the bottom of the vessel through column inlet 6 to outlet 7 where it is discharged in a geyser like manner into the top of the vessel 1. A distributor generally indicated at 8 may be provided for assisting in distribution of the material throughout the annulus of the vessel 1. A vent 9 may be provided in the top of the vessel for discharging from the vessel spent circulating gaseous fluid under pressure.

The improved material withdrawal and fluid flow control apparatus is generally indicated at 25 and is best shown in FIGS. 2 and 3. The material and fluid flow control apparatus 25 includes the aforementioned conduit 16 connected at the opening 10 in the bottom 12 of the vessel 1. It also includes a venturi shaped gaseous fluid inlet nozzle 26 having an upper end 27 which in the closed position shown in FIG. 2 is coextensive with and at the same angle as the conical bottom 12. This end 27 substantially conforms in size and shape to the outlet 10.

A piston-cylinder operated valve means indicated at 28 is provided for closing the gaseous fluid supply conduit 15. The apparatus 25 also includes a piston-cylinder operated valve means 30 mounted in the conduit 16 for controlling the discharge of material from the vessel 10.

When it is desired to circulate material through the vessel in general and in particular through the column 2, it is desirable to have a high velocity gas for entraining in the gas the particulate or pelletized material in the bottom of the vessel and lifting the material up through the column 2. For this purpose, it is desirable to have a small opening. The fluid inlet nozzle 26 with its venturi shape provides this small nozzle and high velocity gas. However, when it is desired to discharge material from the vessel, the small opening provided by the nozzle 26 will restrict the flow of material out of the vessel. In order to overcome this restriction, it would be desirable to have a larger opening such as the size of the opening 10 and conduit 16. According to the present invention, means is provided for adjusting the position of the inlet nozzle relative to the opening 10 for controlling the effective size of the material outlet. This means includes a pair of piston-cylinder means 35 with fluid supply lines 36 and 37 for moving the piston relative to the cylinder and consequently the position of the nozzle 26 relative to the opening 9.

In operation, as previously stated, when it is desired to circulate material within the vessel for mixing or blending purposes, gaseous fluid such as air under pressure is supplied through conduit 15 past open valve 28 up through the nozzle 26 to entrain material in the bottom of the vessel and convey it up through lift column 2 to outlet 7 for discharge into the top of the vessel. In this case, the flow control valve nozzle 26 is in the position shown in FIG. 2 adjacent the opening 10. In this mode of operation, the material flow control valve 30 is in the closed position as shown in the FIG. 2. As can be seen from FIG. 2, when the flow control nozzle 26 is moved towards the opening 10 or discharge of the vessel, the outlet of the vessel decreases in size.

When it is desired to remove material from the vessel, fluid is supplied through lines 27 to raise the cylinder of the piston cylinder means 35 which is mechanically connected to the nozzle 26 by any suitable means such as brackets 38, to move the nozzle 26 away from opening 10. This movement, as shown in FIG. 3 allows material to flow not only through the nozzle 26 to the conduit 16, but also around nozzle 26 through annular area 11 to the conduit 16. This allows material to flow past open valve 30 to the outlet of the system. During the material discharge phase, the valve 28 is closed as shown in FIG. 3 to stop the supply of gaseous fluid to the bottom of the vessel. Thus it can be seen, when it is desired to discharge material from the vessel, the nozzle 26 is moved away from the discharge opening 10 to increase the effective size of the discharge from the vessel.

It should be apparent that the objects of this invention have been carried out. A material withdrawal fluid flow control apparatus has been provided which has the advantage of a small fluid opening to achieve high velocity gas flow, but at the same time permits high volume material withdrawal. It is intended that the foregoing be a description of a preferred embodiment but that the invention be limited solely by that which is within the scope of the appended claims.

I claim:

1. In a vessel for particulate material having a material outlet in the bottom thereof for discharging material from the vessel and means for supplying gaseous fluid under pressure to the vessel through the material outlet, an improved material withdrawal apparatus comprising a conduit mounted on the bottom of the vessel at the material outlet; means defining a gaseous fluid inlet nozzle mounted in said conduit and operatively associated with the material outlet; and means for adjusting the position of the inlet nozzle for controlling the effective size of the material outlet by moving the inlet nozzle between a first position to increase the effective size of the material outlet during material withdrawal and a second position to reduce the effective size of the material outlet when gaseous fluid under pressure is supplied to the vessel.

2. In a vessel for particulate material according to claim 1 wherein said inlet nozzle is a hollow thimble coaxially aligned with the material outlet and the means for adjusting the position of the nozzle includes means for vertically moving said thimble relative to material outlet.

3. In a vessel for particulate material according to claim 2 wherein said thimble is venturi shaped with its upper end having a size and shape that substantially conforms to the size and shape of the material outlet.

4. In a vessel for particulate material according to claim 3 wherein said means for adjusting the position of the nozzle includes at least one piston-cylinder means for moving the thimble away from the outlet to said first position when it is desired to increase the effective size of the material outlet to withdraw material from the vessel and for moving the thimble to said second position against the material outlet when it is desired to supply gaseous fluid to the vessel through the inlet nozzle.

5. In a vessel for particulate material according to claim 4 further comprising first valve means operatively associated with said means for supplying gaseous fluid under pressure to the vessel adapted to be opened when gaseous fluid under pressure is supplied to said vessel and adapted to be closed to prevent gaseous fluid flow to said vessel when material is discharged from the vessel.

6. In a vessel for particulate material according to claim 5 further comprising second valve means mounted in said conduit adapted to be opened when material is discharged from said vessel and adapted to be closed when gaseous fluid under pressure is supplied to said vessel.

* * * * *